United States Patent [19]

Merry

[11] 4,236,475

[45] Dec. 2, 1980

[54] SAIL FEEDER

[75] Inventor: Carl A. Merry, Marion, Mass.

[73] Assignee: Schaefer Marine, Inc., New Bedford, Mass.

[21] Appl. No.: 62,925

[22] Filed: Aug. 2, 1979

[51] Int. Cl.[3] ..... B63H 9/08

[52] U.S. Cl. ..... 114/90; 114/102

[58] Field of Search ..... 114/90, 101, 102, 104, 114/105, 108, 111, 112, 218; 242/157 R

[56] References Cited

U.S. PATENT DOCUMENTS

| | | | |
|---|---|---|---|
| 2,660,972 | 12/1953 | Wiseman | 114/218 |
| 3,759,210 | 9/1973 | Davis | 114/108 X |

FOREIGN PATENT DOCUMENTS

| | | | |
|---|---|---|---|
| 1488432 | 6/1967 | France | 114/102 |

*Primary Examiner*—Sherman D. Basinger
*Attorney, Agent, or Firm*—Cesari and McKenna

[57] ABSTRACT

A sail feeder for mounting on a mast formed with a sail receiving slot, said slot having an enlarged entrance for receiving the bolt rope of a mainsail, includes a rigid plate having a pair of legs projecting out from the plate at laterally-spaced locations thereon. The legs are oriented at the same acute angle relative to the plate and they are toed toward one another so that their free ends are spaced apart a distance less than the spacing between their ends attached to the plate. The said feeder is arranged to be secured to the mast at a location directly below the slot entrance. When raising the sail, the end of the bolt rope at the head of the sail is passed through the sail feeder and thence into the slot via its entrance. As the sail is raised by the main halyard, the bolt rope is drawn through the sail feeder which aligns the rope with the slot entrance so that hoisting of the sail can proceed without any need of manually aligning the bolt rope with the slot entrance or the feeder.

8 Claims, 4 Drawing Figures

SAIL FEEDER

This invention relates to an item of marine hardware. It relates more particularly to an improved sail feeder.

BACKGROUND OF THE INVENTION

In many conventional sailboats, the luff edge of the mainsail is slidably affixed to the mast. More particularly, a bolt rope is secured to that edge of the sail by a bolt tape engaged around the rope and stitched to the sail at opposite sides thereof. To facilitate raising and lowering the sail on the mast, the boat rope engages in a slot or track formed in the aft wall of the mast, the end of the boat rope at the upper end of the sail being introduced into the slot through an enlarged entrance opening at the lower end of the slot just above the boom. The head of the sail is connected to a main halyard and hoisted up the mast by the halyard with the bolt rope feeding into the slot through the entrance opening.

Due to the fact that the lowered sail is folded or bunched together at the boom, the luff edge of the sail containing the bolt rope is not necessarily aligned with the mast or more particularly its slot. Accordingly, as the sail is being raised, the bolt rope does not automatically feed properly into its slot in the mast. Consequently, someone usually has to be present at the foot of the mast to guide the bolt rope into that slot by hand to prevent its becoming jammed.

Some attempts have been made to alleviate this problem by providing a specially shaped insert in the mast at the entrance to the bolt rope slot. However, installation of that insert involves cutting a hole in the mast at the slot entrance in which to seat the insert. Accordingly, as a practical matter, that fixture must be installed in the mast by the mast supplier at its plant. It cannot be retrofit on existing masts on working boats. Also such inserts, being cast metal parts, are relatively expensive to make.

SUMMARY OF THE INVENTION

Accordingly, the present invention aims to provide an improved sail feeder.

Another object of the invention is to provide a sail feeder which can be retrofit on existing masts.

Another object of the invention is to provide such a marine hardware item which is relatively inexpensive to make and install.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my sail feeder is designed to be installed on any conventional mast having a track or slot for slidably receiving the bolt rope incorporated into the luff edge of a mainsail. The feeder includes a small rigid metal plate. A pair of short cylindrical legs are secured at corresponding ends thereof to the plate at spaced-apart locations thereon, the spacing between those ends being greater than the diameter of the bolt rope. Both legs are inclined relative to the plate, being disposed at an angle of approximately 35° to 55° relative to the plate. Also, the legs are toed inward toward one another so that their free ends are spaced apart a distance not appreciably greater than the thickness of the sail. Also, those free ends are rounded to present smooth contoured surfaces.

The sail feeder is designed to be positioned directly below the enlarged entrance to the sail slot in the mast. For this purpose, countersunk screw openings are formed in the plate and the plate is secured to the mast by engaging screws through these openings and turning them down into registering openings drilled into the aft wall of the mast.

When hoisting the sail, the end of the bolt rope at the head of the sail is inserted under the legs of the sail feeder, with the sail itself extending out through the gap between the free ends of those legs. Then the bolt rope is guided into the slot entrance in the mast and into the slot itself. This is all done by hand. From this point on, as the sail is raised by the main halyard, incremental lengths of the bolt rope are pulled into the sail feeder and automatically aligned with the slot entrance so that they proceed readily into the slot. Even though the portion of the sail below the sail feeder may be wrinkled, bunched or out of alignment with the feeder, the toed-in upwardly-angled orientation of the legs on the sail feeder enables succeeding incremental lengths of the bolt rope to be drawn between the legs freely and easily with the result that by the time those incremental lengths are drawn past the free ends of those legs, those lengths are straight and correctly aligned with the slot entrance. Consequently, the sail can be raised without requiring any hand manipulation of the sail in order to guide it into the sail feeder or the mast slot. As a result, the sail can be raised by one person with a minimum amount of effort in a minimum amount of time.

The sail feeder itself is easily manufactured and therefore it is quite inexpensive. Furthermore, it can be retrofit on most conventional masts having an internal sail track or slot simply by drilling the necessary holes in the mast below the slot entrance in order to receive the screws projecting through the sail feeder plate. Accordingly, the sail feeder should find wide application on those sailboats having sail tracks on their masts.

BRIEF DESCRIPTION OF THE DRAWING

For a fuller understanding of the nature and objects of the invention, reference should be had to the following detailed description taken in connection with the accompanying drawing, in which.

DESCRIPTION OF THE PREFERRED EMBODIMENT

Figure 1:
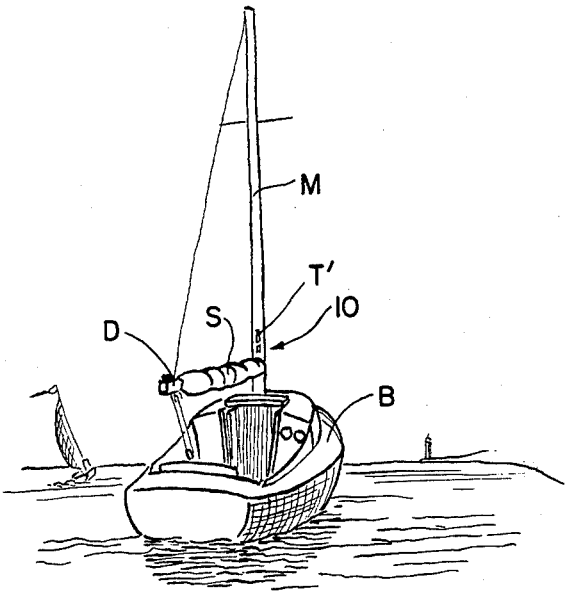
FIG. 1 is a perspective view of a sailboat fitted with a sail feeder made in accordance with this invention.

Referring to FIG. 1 of the drawing, a boat B having a hollow extruded aluminum mast M and boom D for supporting a mainsail S is fitted with a sail feeder made in accordance with this invention and indicated generally at 10.

Figure 2:
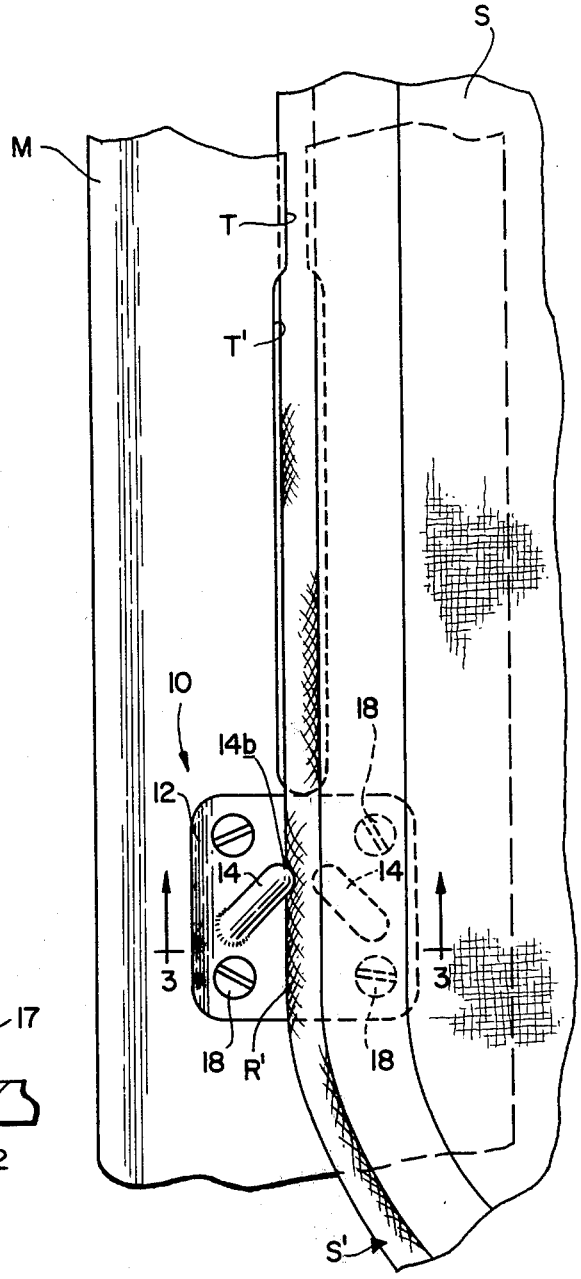
FIG. 2 is a fragmentary elevational view on a much larger scale showing the sail feeder in greater detail.
Figure 3:
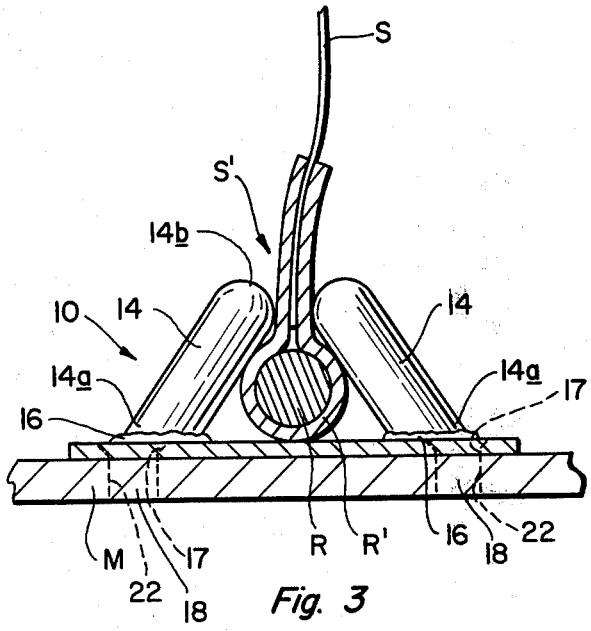
FIG. 3 is a sectional view along line 3—3 of FIG. 2 on a still larger scale.
Figure 4:
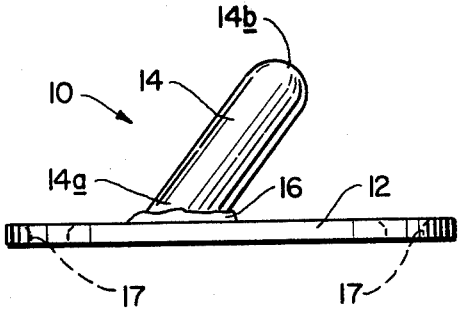
FIG. 4 is a side elevational view of the sail feeder.

Turning now to FIGS. 2 to 4, the mast M is formed with a vertical internal track or slot T in its aft wall. The track extends from a point above the point of attachment of the boom D to the mast all the way to the top of the mast. The slot T has the usual enlarged vertically-elongated entrance or opening T′ to facilitate starting the sail S into the slot when raising the sail.

As best seen in FIGS. 2 and 3, the sail S has the usual bolt range R incorporated into the luff edge S′ of the sail by a bolt tape R′ engaged around the bolt rope and secured to opposite sides of the sail by means of stitching or other suitable means. Normally when raising the sail, the end of the bolt rope adjacent the head of the sail is inserted into the slot entrance T′ and drawn up along the slot T as the sail is raised by the main halyard, with the succeeding lengths of rope being pulled along the slot thereafter.

To prevent the bolt rope from becoming jammed in the slot entrance T′ and to enable it to be drawn into the slot entrance without any manual assistance, the sail feeder 10 is installed on the mast just below the bottom of the slot entrance T′. The feeder 10 comprises a small square rigid plate 12 having rounded corners made of stainless steel, aluminum or other comparable material.

A pair of short cylindrical rod-like legs 14 also made of stainless steel, aluminum or other such metal are secured at their corresponding ends 14*a* to plate 12 at laterally spaced-apart locations thereon, the spacing between those ends being greater than the diameter of the bolt rope R plus twice the thickness of the bolt tape R′ as best seen in FIG. 3. The rod ends 14*a* are cut on a bias so that those ends present faces which make an acute angle with the leg axis. The bias angle should be between 40° and 70° relative to the axis of the leg; most preferably, it is about 50° relative thereto. Furthermore, the legs 14 are toed in toward one another as best seen in FIG. 2 so that their free ends 14*b* are spaced apart a distance appreciably less than the diameter of the bolt rope R plus twice the thickness of the bolt tape R′. Resultantly, those legs 14*b* can overhang a bolt rope (and tape) and trap it between them and plate 12. The leg ends 14*b* are also gently rounded so as to present smooth surfaces to the bolt tape R′.

With the legs 14 toed toward one another as aforesaid, they then make an angle of approximately 35° to 65°, most preferably 45°, with plate 12 as best seen in FIG. 4. With the legs in those positions, the leg ends 14*a* are rigidly secured to plate 12 by weld beads 16 extending all around the legs. Those weld beads are tumbled and electropolished after welding so that they are relatively smooth and then the entire sail feeder is passivated to make it resistant to salt water corrosion.

Plate 12 is formed with four countersunk openings 17 near its four corners for receiving four flat head chrome plated screws 18. The feeder is affixed to mast M just below the lower end of slot entrance T′ and with the gap between the legs 14 centered on the longitudinal axis of entrance T′ by turning screws 18 down into registering openings 22 (FIG. 3) drilled into the rear face of the mast. Thus the feeder is easily installed by the average handyman without requiring any special tools or equipment and without appreciably modifying the mast or its slot entrance T′.

In order to insert the end of the bolt rope at the head of the sail into the slot T when raising the sail, the bolt rope is first passed under the legs 14 of the sail feeder and thence into slot T via its enlarged entrance T′. As best seen in FIG. 3, the plate 12 and legs 14 of the feeder 10 trap the bolt rope (and tape) so that, at the point where the luff edge S′ of the sail passes under those legs, the bolt rope is aligned with the longitudinal axis of the slot entrance T′ as illustrated in FIG. 2.

After the bolt rope end has been inserted into the slot T, the sail S can be raised in the usual way using the main halyard. As the sail is pulled up from its head along slot T, the luff edge of the sail S′ containing the bolt rope is pulled past the sail feeder. The orientation of the legs 14, namely their upward inclination and toe-in, automatically aligns the bolt rope with the lower end of the entrance T′ even though the luff edge of the sail S′ below the sail feeder is completely misaligned with the feeder and with the slot entrance due to its being gathered or bunched together at the boom D.

As best seen in FIGS. 2 and 4, the upward inclination of the legs 14 coupled with their toe-in tends to straighten each incremental length of the boat rope R before that length passes under the free ends 14*b* of the legs. Consequently by the time the boat rope leaves the legs, it is substantially aligned with the sail entrance T′. Accordingly, no additional effort need be expended manually aligning the edge of the sail with the sail feeder. Therefore, inclusion of the sail feeder 10 on the mast M greatly facilitates raising the sail, particularly a large one.

It will thus be seen that the objects set forth above, among those made apparent from the preceding description, are efficiently attained and, since certain changes may be made in the above description without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described.

What is claimed as new and desired to be secured by Letters Patent of the United States is:

1. In a sailboat mast provided with a slot for receiving the bolt rope incorporated into the luff edge of a sail, said slot having an enlarged entrance near the foot of the mast, the improvement comprising a sail feeder positioned below the slot entrance, said sail feeder including a rigid plate secured to the mast and a pair of short, generally cylindrical legs having corresponding first ends which are cut on a bias relative to the leg axes, said corresponding leg first ends being positioned flush against said plate at laterally spaced locations thereon, said spacing being greater than the diameter of the sail bolt rope, said legs also being oriented so that they are upwardly angled relative to the plate and the mast and toed-in toward one another so that the legs are oriented at an angle of 35° to 65° relative to the plate and their corresponding second ends are spaced apart a distance less than the diameter of the sail bolt rope, said second leg ends being positioned at equal distances on opposite sides of the extended center line of the slot entrance, and means for rigidly securing said leg first ends to said plate so that when the luff edge of the sail is engaged in the sail feeder with the sail bolt rope slidably received between said plate and said legs, the sail bolt rope is aligned with the slot entrance so that, when the sail bolt rope is pulled along the slot in the mast, the sail feeder automatically aligns incremental lengths of the bolt rope with the slot entrance.

2. The sail feeder defined in claim 1 wherein said legs comprise short cylindrical rods.

3. The sail feeder defined in claim 2 wherein the corresponding second ends of the rods are gently rounded so as to present smooth surfaces to the bolt rope.

4. The sail feeder defined in claim 1 wherein the plate legs and leg securing means are made of stainless steel or aluminum.

5. A sail feeder for leading a sail bolt rope into the entrance of a bolt rope-receiving mast slot said feeder comprising a rigid metal plate, a pair of short cylindrical legs, each leg having a first end and a second end, said leg first ends being positioned flush against the plate at laterally-spaced locations thereon, said legs being oriented at the same acute angle with respect to the plate, said legs also being toed inward toward one another so that their corresponding second ends are spaced apart a distance appreciably less than the distance between their corresponding first ends and less than the diameter of the bolt rope, and means for securing said leg first ends to the plate.

6. The sail feeder defined in claim 5 and further including means defining screw openings at spaced-apart locations on the plate.

7. The sail feeder defined in claim 5 wherein said toed-in legs are oriented at an angle of from 35° to 65° relative to the plate.

8. The sail feeder defined in claim 7 wherein said angle is approximately 45°.

* * * * *